US006989074B2

(12) United States Patent
Egan, III et al.

(10) Patent No.: US 6,989,074 B2
(45) Date of Patent: Jan. 24, 2006

(54) PAPER PULP REFINER CONTROL SYSTEM AND METHOD USING ACTIVE HYDROSTATIC BEARINGS

(75) Inventors: John J. Egan, III, Centerville, OH (US); Christopher L. Demler, Lebanon, OH (US)

(73) Assignee: Kadant Black Clawson Inc., Mason, OH (US)

( * ) Notice: Subject to any disclaimer, the term of this patent is extended or adjusted under 35 U.S.C. 154(b) by 249 days.

(21) Appl. No.: 10/220,880

(22) PCT Filed: Mar. 7, 2001

(86) PCT No.: PCT/US01/07208

§ 371 (c)(1),
(2), (4) Date: Dec. 9, 2002

(87) PCT Pub. No.: WO01/66255

PCT Pub. Date: Sep. 13, 2001

(65) Prior Publication Data

US 2003/0205634 A1 Nov. 6, 2003

Related U.S. Application Data

(60) Provisional application No. 60/187,438, filed on Mar. 7, 2000.

(51) Int. Cl.
*D21B 1/04* (2006.01)

(52) U.S. Cl. ..... 162/28; 162/252; 162/234; 162/261; 162/254; 241/261.2; 241/261.3

(58) Field of Classification Search ..... 162/252, 162/234, 261, 254, 28; 241/28, 259.2, 261.2, 241/261.3

See application file for complete search history.

(56) References Cited

U.S. PATENT DOCUMENTS

| | | | | |
|---|---|---|---|---|
| 2,666,368 | A | | 1/1954 | Staege et al. |
| 4,136,831 | A | | 1/1979 | Cederquist et al. |
| 4,171,101 | A | | 10/1979 | Seifert et al. |
| 4,378,092 | A | | 3/1983 | Reinhall |
| 4,402,463 | A | * | 9/1983 | Kahmann et al. ..... 241/37 |
| 4,725,007 | A | * | 2/1988 | Chupka ..... 241/46.02 |
| 4,754,935 | A | * | 7/1988 | Gullichsen ..... 241/19 |
| 5,323,972 | A | | 6/1994 | Kjellqvist |
| 5,383,608 | A | * | 1/1995 | Dahiqvist et al. ..... 241/16 |

(Continued)

FOREIGN PATENT DOCUMENTS

| | | |
|---|---|---|
| WO | WO92/005874 | 4/1992 |
| WO | WO99/19070 | 4/1999 |
| WO | WO99/52197 | 10/1999 |

*Primary Examiner*—Mark Halpern
(74) *Attorney, Agent, or Firm*—Wegman Hessler & Vanderburg

(57) ABSTRACT

A paper pulp refiner with control system employs active hydrostatic bearings for supporting the refiner rotor, at least in part, the hydrostatic bearings are defined between the refiner rotor plates (25, 55) and stator plates (22, 60) through openings (40, 62, 85) formed in the stator plates for the admission of active hydrostatic fluid. The control fluid flows into the refiner gap under controlled volume and pressure, employing the refining plates as active hydrostatic bearings and flows into the process fluid. Hydrostatic control fluid is used, which is non-contaminated to the process fluid. The rotors of the paper pulp refiners may also be controlled by hydrostatic bearing surfaces formed between relative rotating and non-rotating components, such surfaces having passageways also opening into the process fluid. In the event of loss of control or function, the refiner may continue to operate on the hydrostatic bearings until the control function can be restored.

7 Claims, 5 Drawing Sheets

U.S. PATENT DOCUMENTS 5,704,559 A * 1/1998 Froberg et al. ..... 241/261.3
5,795,073 A 8/1998 Arvidsson et al.
5,947,394 A 9/1999 Egan, II et al.
5,975,438 A 11/1999 Garasimowicz
6,082,901 A 7/2000 Arvidsson
6,756,757 B2 * 6/2004 Marcinkiewicz et al. ... 318/432

* cited by examiner

PAPER PULP REFINER CONTROL SYSTEM AND METHOD USING ACTIVE HYDROSTATIC BEARINGS

CROSS-REFERENCE TO RELATED APPLICATIONS

Priority filing benefit of (1) International PCT application PCT/US01/07208 filed Mar. 7, 2001, and published under PCT 21(2) in the English language and (2) U.S. Provisional Application Ser. No. 60/187,438 filed Mar. 7, 2000.

BACKGROUND OF THE INVENTION

This invention relates primarily to paper pulp refiners and similar rotating equipment in which one or more processing elements rotate with opposed working surfaces in close proximity to other such elements, some of which are mounted and driven for rotation, and others of which are stationary.

In such equipment, the rotor positioning and rotor gap maintenance is critical for optimum performance. A paper pulp refiner may have twin discs, that is a central rotating disc having opposite faces, and opposed non-rotating discs, as shown for example in the Seifert et al. U.S. Pat. No. 4,171,101. However, refiners may employ a single rotary disc or may have a plug-type Jordan refiner elements, as shown for example in Staege U.S. Pat. No. 2,666,368.

Accurate positioning of the rotating member with respect to the non-rotating members is necessary for optimum performance and for control in quality variations. Also, mechanical positioning problems can reduce the life of refining plates. Further, in conventional refiners, the bearings are lubricated with materials that may not be mixed with, and do not tolerate, the process fluid. Therefore, when a bearing seal fails, the refiner also fails, and must be shut down.

The inventors herein previously have addressed the needs of refiner systems and the maintenance of accurate refining gaps and rotor positioning by using magnetic bearings, as disclosed in their U.S. Pat. No. 5,947,394 issued Sep. 7, 1999, and incorporated herein by reference.

SUMMARY OF THE INVENTION

The present invention addresses the problem by incorporating active hydrostatic bearings as an integral part of the refiner. Hydraulic hydrostatic bearings have been suggested for control of the positions of refiner elements as shown, for example, in the Arvidsson U.S. Pat. Nos. 6,082,901 and 5,795,073, and in Kjellqvist U.S. Pat. No. 5,323,972. The disclosures of these patents have in common the fact that the hydrostatic control fluid is hydraulic fluid and is applied directly to piston-like control members that form part of a closed fluid servo-circuit. The hydraulic fluid is at all times isolated from the processing fluid. Thus, in the case in which a motor rotor or other rotating element operates within the processing fluid, and it is desired to suspend or support such element by hydrostatic fluid, the design becomes complicated in that the piston or actuator elements must seal the hydraulic fluid from the processing fluid, and are generally positioned remotely of the processing elements or plates for ease of access to such controlling surfaces and to prevent intermixing of the fluids.

The apparatus and method of the present invention differs significantly from such prior hydrostatic control systems for refiners in that the control fluid is the same as, or at least is compatible with, the processing fluid in the sense that it is non-contaminating of the fluid process. A further important distinction resides in a control method and apparatus in which the active hydrostatic bearing injection fluid is applied to bearing support surfaces formed on or made a part of existing rotor components, such as to a confined surface of a refiner plate or to surfaces of a motor rotor, by which means the rotor element is suspended on such a hydrostatic fluid layer, and the position, axially and/or radially, of the rotor is thus controlled by controlling the velocity and pressure of the active hydrostatic bearing fluid. Such fluid, in the case of the refiner, may be, for example, a diluted pulp suspension or, as a further example, processed white water of the paper processing plant, or simple pure water, as examples. In every case, the active hydrostatic bearing control fluid, after expending its energy, is allowed to flow into the process and mix with the process fluid.

The invention includes unexpected and non-obvious advantages over hydrostatic bearing systems that are closed end hydraulic systems. First, the present invention uses as bearing surfaces the existing surfaces of the refining plates (or plate supports) as bearing surfaces, thereby simplifying the machining, manufacture and production of such units, and potentially reducing the physical size and costs of such units. In such cases, the existing working surfaces of a rotating element may comprise all that is required for axial or radial positions control.

A further important advantage resides in the fact that the refiner may continue to operate in the event of loss of hydrostatic control in that the system will revert to a simple hydrostatic bearing arrangement to maintain rotor levitation and positioning using process compatible fluid. Accordingly, such a run safe benefit has great advantage in that a refiner may continue to function until the controller is serviced. Thus, with loss of active control, the system reverts to a hydrostatic support system in which the rotor floats axially and is centered due to the balance in hydrostatic forces. The system has particular use with motor rotors and refining plates of the type as disclosed in applicants' international application WO 99/52197 published Oct. 14, 1999, incorporated herein by reference.

The technology, according to this invention, allows for precise, active control of the elements that make up a refining interface. These allow for improved processing uniformity, and adjustment to desired process changes for improved treatment uniformity.

The invention further allows for a sealed refiner unit with the elimination of grease lubricated bearings that can cause unexpected down time. Unlike magnetic bearings, the active hydrostatic bearing lends more readily to using the refiner surface systems themselves as bearing surfaces. This simplifies machine design and reduces size.

It is therefore an important object of this invention to provide a method and apparatus by which active hydrostatic control is applied to a paper pulp refiner or the like, in which the hydrostatic fluid is compatible with and flows into the process fluid flowing through the refiner.

A further important object of the invention is to provide a hydrostatic control system in a refiner and the method of operating a refiner, as outlined above, that is fail safe in that loss of active control of the hydrostatic fluid does not, alone, require shut down of the refiner.

A still further object of the invention is a provision of a refiner method and apparatus, as previously defined, in which a rotor floats axially and is centered by controlled continuous injections of a hydrostatic liquid, and the rotor maintains a clearance by running on film-type hydrostatic bearings, even in the event of loss of active control of the hydrostatic system.

A particular advantage of the invention resides in the utilization of existing rotary components as hydrostatic control surfaces, thereby simplifying the mechanical design of the refiner. As an example, the surface of a refiner plate (or the plate support) may be used as one hydrostatic control surface.

Other objects and advantages of the invention will be apparent from the following description, the accompanying drawings and the appended claims.

DETAILED DESCRIPTION OF THE PREFERRED EMBODIMENT

Figure 1:
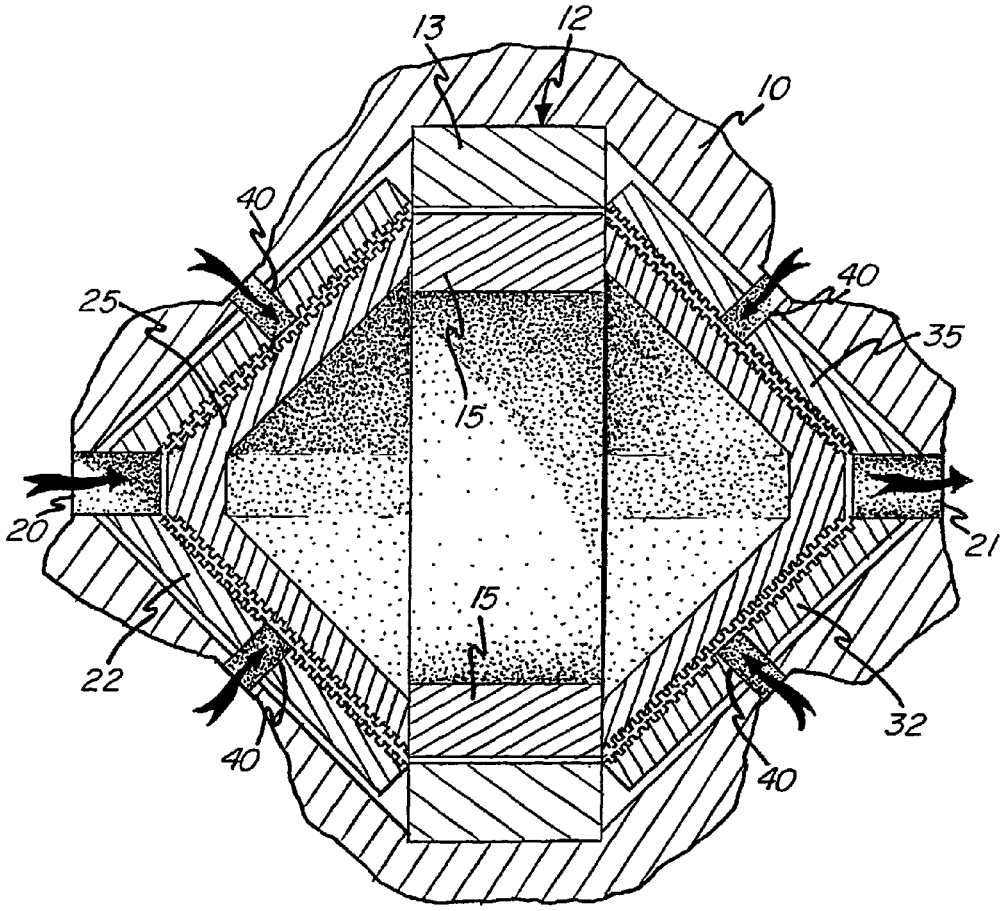
FIG. 1 diagrammatically illustrates a balanced twin-disc central rotor driven refiner having opposed Jordan or conically shaped rotor supported refiner plates cooperating with matching non-rotating plates in the housing, in which the refiner plates are driven from an internal motor rotor submerged in the processing fluid stream.

Referring to the drawings that illustrate preferred embodiments of the invention, beginning with FIG. 1, a refiner, according to this invention, is shown as including an outer housing 10 supporting a switched reluctance motor 12 having a stator 13 and a rotor 15 therein. In this embodiment, the rotor is "shaftless" in that it is suspended within the housing, and the rotor operates within the process fluid.

Two sets of refiner plates are used, arranged in interfitting frusto-conical form or plug-type form about a central-transverse axis, including the inlet 20 and the process outlet 21. The first set of refiner plates includes a frusto-conical stationary plate 22 positioned and supported in the housing 10 and preferably arranged for axial adjustability by movement parallel to the central axis, in relation to an inner frusto-conical rotary refining plate 25 mounted for rotation on the rotor 15.

A second set of such refiner plates, forming a mirror image of the first set, are associated with the outlet 21 and include a stator plate 32 on the housing, preferably mounted for axial adjustment, and a rotor plate 35 fitted within the plate 32 and mounted for rotation on the rotor 15.

The flow of process fluid through the refiner is in serial fashion in that the suspension of paper pulp passes from the inlet 20 first between the stationary plate 22 and rotary plate 25, and then through the gap between the rotor and stator (or through guide openings in the periphery of the rotor and/or stator (not shown)) to the interface between plates 32 and 35 for a second stage of refining for discharge through the outlet 21.

The rotor 15 and the plates 25 and 35 are suspended within the housing 10 by controlled hydrostatic forces developed by fluid pressure applied to inlet passageways 40 formed in the stator plates 22 and 32. The passageways 40 lead from the exterior of the housing 10 and through the respective stator plates into the interface between the rotating and stationary plates and provide for the application of a process fluid compatible control fluid, as previously described, under variable pressure and volume conditions so that the rotor and the associated plates are hydrostatically supported for rotation within the housing 10. It is understood that a controller, described in further detail in connection with the embodiments of FIGS. 3 and 4, modulates the pressure and volume of applied hydrostatic fluid through the openings 40 into the annular interfaces between the stationary and rotating components at the opposed refiner surfaces in accordance with signals from sensors that monitor the positions of the rotor with respect to the stator components, as known in the art.

It is within the scope of the invention to use any suitable sensor signal, such as sensors that measure physical gaps, or sensors that measure motor electrical load, or torque, or measure acoustical footprints of the rotating components as an indication of rotor position and working gaps.

Figure 5:
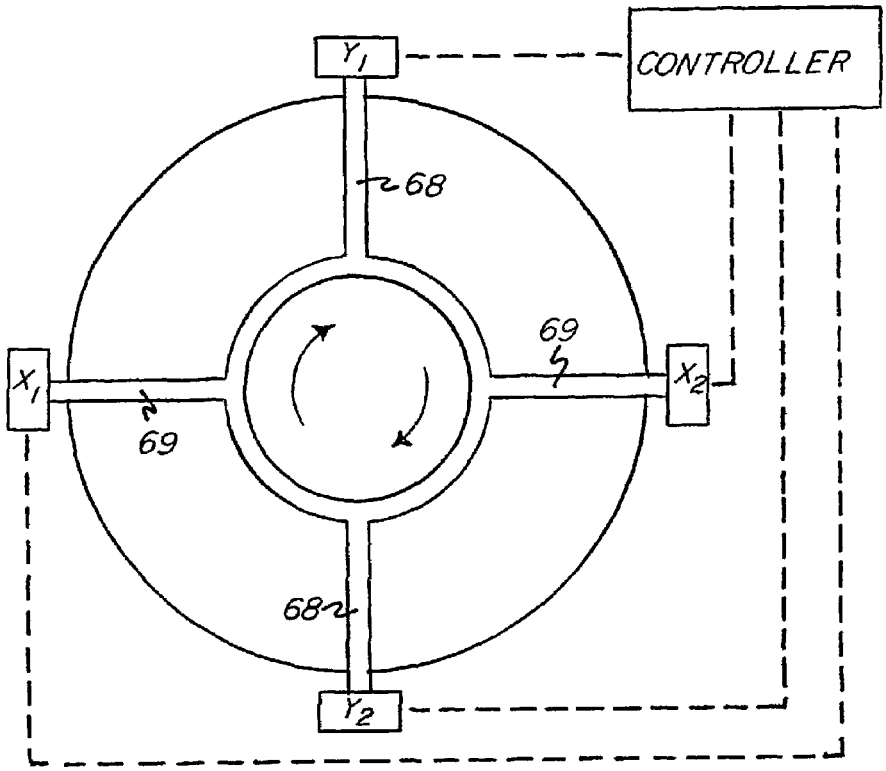
FIG. 5 is a sectional view showing the two axis control applied to a radial bearing looking generally along the line 5—5 of FIG. 3.

It will be apparent that both axial and rotational positions of the rotor may be controlled by suitably controlling the relative forces in terms of velocity and pressure applied through the respective openings 40. It will be understood that a plurality at the openings 40 may be located in each of the plates 22, 32, preferably at least four in each plate, at quadrature positions, to provide more precise control of the x and y axes, as shown for example in FIGS. 5 and 6. It should also be noted that the embodiment of FIG. 1 requires no extra bearing surface since the rotating elements alone provide the necessary bearing surfaces. Unlike magnetic bearings, the active hydrostatic bearings lend themselves to using the refining surfaces as the bearing surface, providing simplification of the machine and permitting a reduction in its size. The embodiment of FIG. 1 is accordingly a sealed unit, eliminating conventional bearings that may cause unexpected down times due to bearing failure or failure of the seals.

Figure 2:
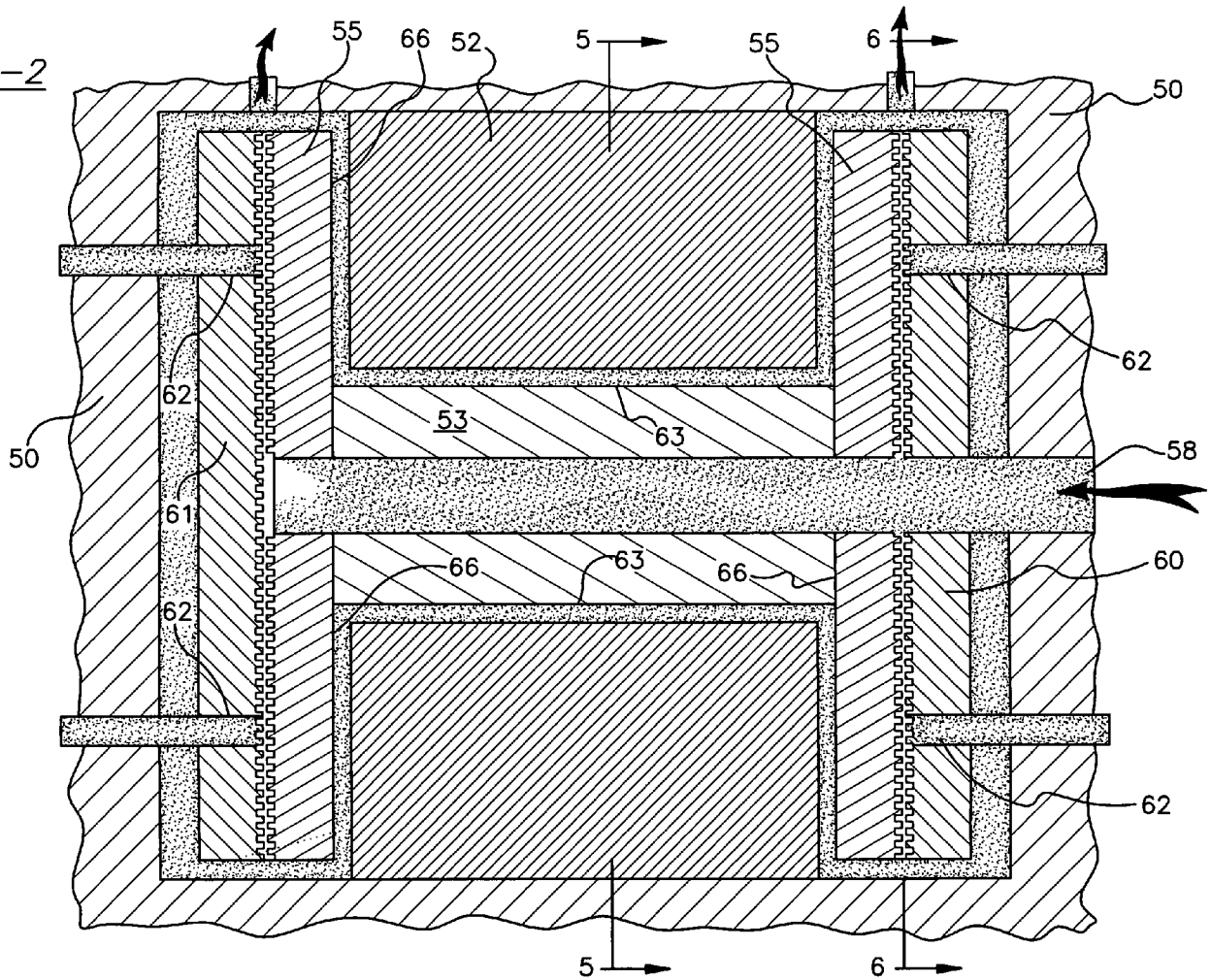
FIG. 2 is a diagram illustrating another manner in which a rotor, such as the rotor of a switched reluctance motor of the type shown in WO 99/52197 may be supported and controlled.

The arrangement of FIG. 2 illustrates diagrammatically how the hydrostatic bearing concept and method of this invention may be applied to a twin disc refiner having an integrated rotor of the kind shown and described in international publication WO 99/52197. The housing 50 includes a stator 52 of a switched reluctance motor and a rotor 53 that operates within the process fluid. The axial ends of the rotor are formed as or include radial extending refiner plate surfaces 55 at the opposed ends, receiving paper pulp stock to be refined through the axial inlet opening 58. The opposed ends of the housing enclose and support relatively non-rotating radial refiner plates 60 and 61 which may be positioned by micro-adjusters (not shown, corresponding to reference numeral 48 in the international application).

Figure 6:
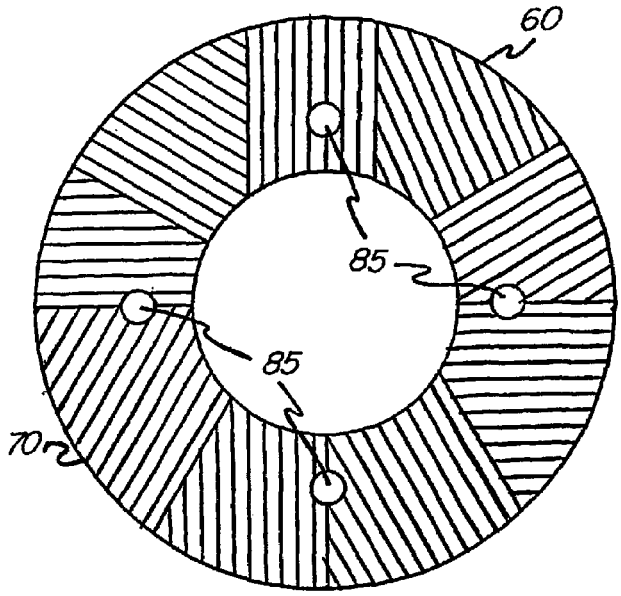
FIG. 6 is an end view of a stationary refiner plate with four injection points looking generally along the line 6—6 of FIG. 3.

As described previously, the refining surfaces themselves may be employed as active hydrostatic bearing surfaces with inlet openings 62 as diagrammed in FIG. 6 through each of the plates 60, 61. The axial center surface 63 of the rotor and the abutting inside radial surfaces 66 of the plates 55 may also be used as hydrostatic bearing surfaces, with fluid applied as through opposed radial access openings 68, 69 as shown diagrammatically in FIG. 5, to apply x and y axis control.

It should be remembered that the active hydrostatic bearing concept of this invention, as shown in FIGS. 1 and 2, has the potential of being operated in a fail safe condition in that if the control system itself fails, the system can revert to a simple hydrostatic bearing and maintain the rotor in a levitated position using non-contaminating or compatible hydrostatic fluid, such as the process fluid itself. In the embodiment of FIG. 2, the rotor 53 will float axially and remain centered due to the hydrostatic forces that are induced by the relative rotation of the rotor and stator surfaces and will maintain a running film in the interface spaces between such surfaces.

Figure 3:
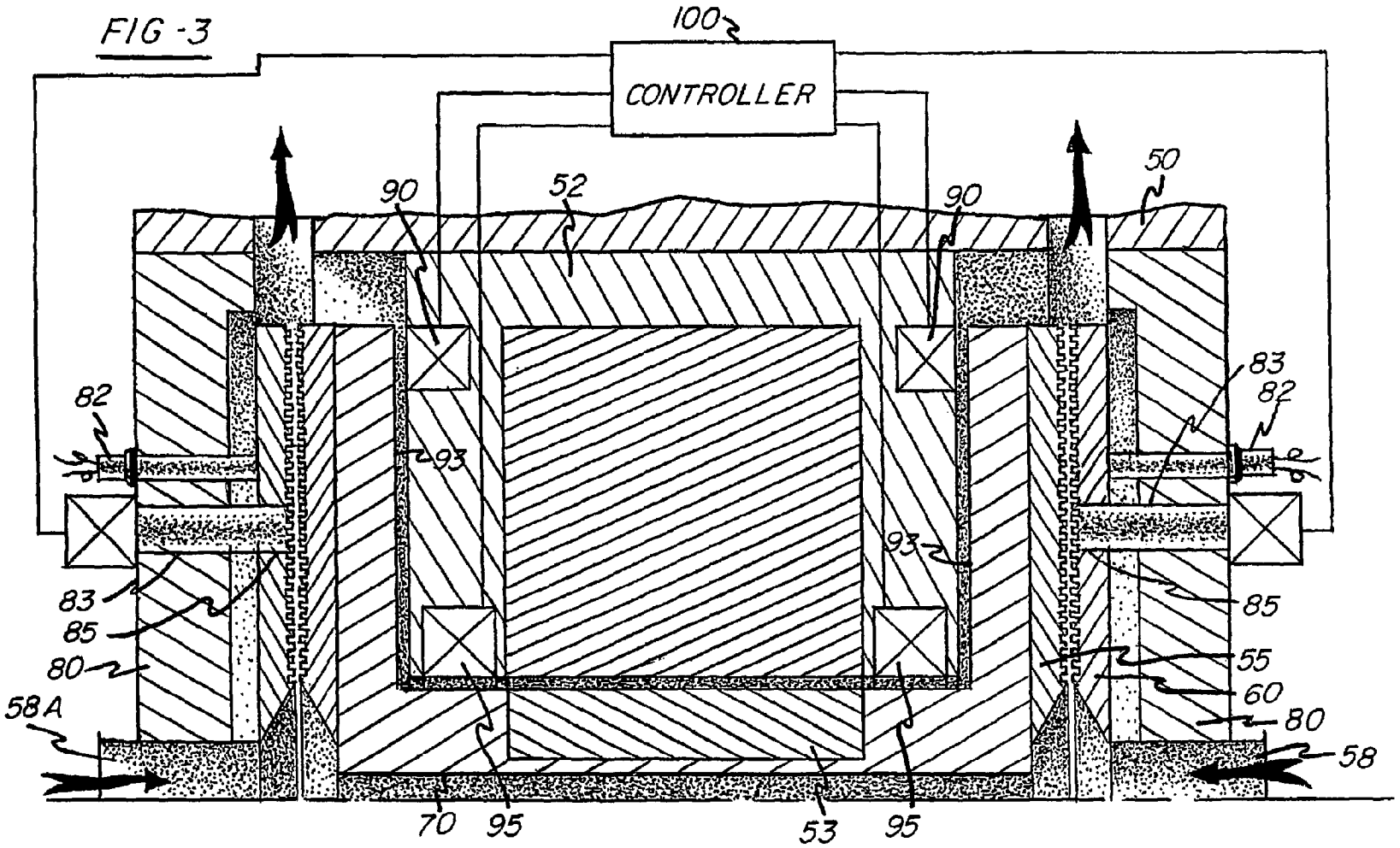
FIG. 3 is a partial sectional view of a twin disc refiner, similar to FIG. 2, diagrammatically showing a controller and further showing that the stator adjustments may also be controlled by the controller.

FIG. 3 diagrammatically shows a partial or half sectional view through a refiner of the kind diagrammed in FIG. 2, in which like components are designated by like reference numerals. In addition to the inlet 58, the second inlet 58A may be employed at the opposite end, or alternatively, the end may be formed as a blank so that the stock is fed through the axial passageway 70 through the rotor 53.

The housing ends 80 include adjustment mechanisms that may include electrical micro-adjusters 82, as described at reference numeral 48 in the international application and/or additionally, a hydrostatic opening or passageway 83, leading through openings 85 (FIG. 6) in the stator plate for the application of hydrostatic fluid within the refining space between the refining plates 55 and 60. The annular bearing pairs diagrammatically illustrated at 90 operate in conjunction with the adjacent radial face 92 of the rotor 53 to provide further axial control of the position of the rotor and its respective refining plates 55, while bearing pairs diagrammatically illustrated at 95 provide radial support Fluid may be applied to the pairs 90 and 95 under conditions of controlled volume and pressure by the diagrammatically illustrated controller 100 in accordance with sensor pick up signals, as previously described. The controller may operate the stator micro-adjusters electrically for adjustment and control of gap clearances, or alternatively, as shown in FIG. 4, they apply active hydrostatic fluid through stator refining openings 62 (FIG. 6).

Figure 4:
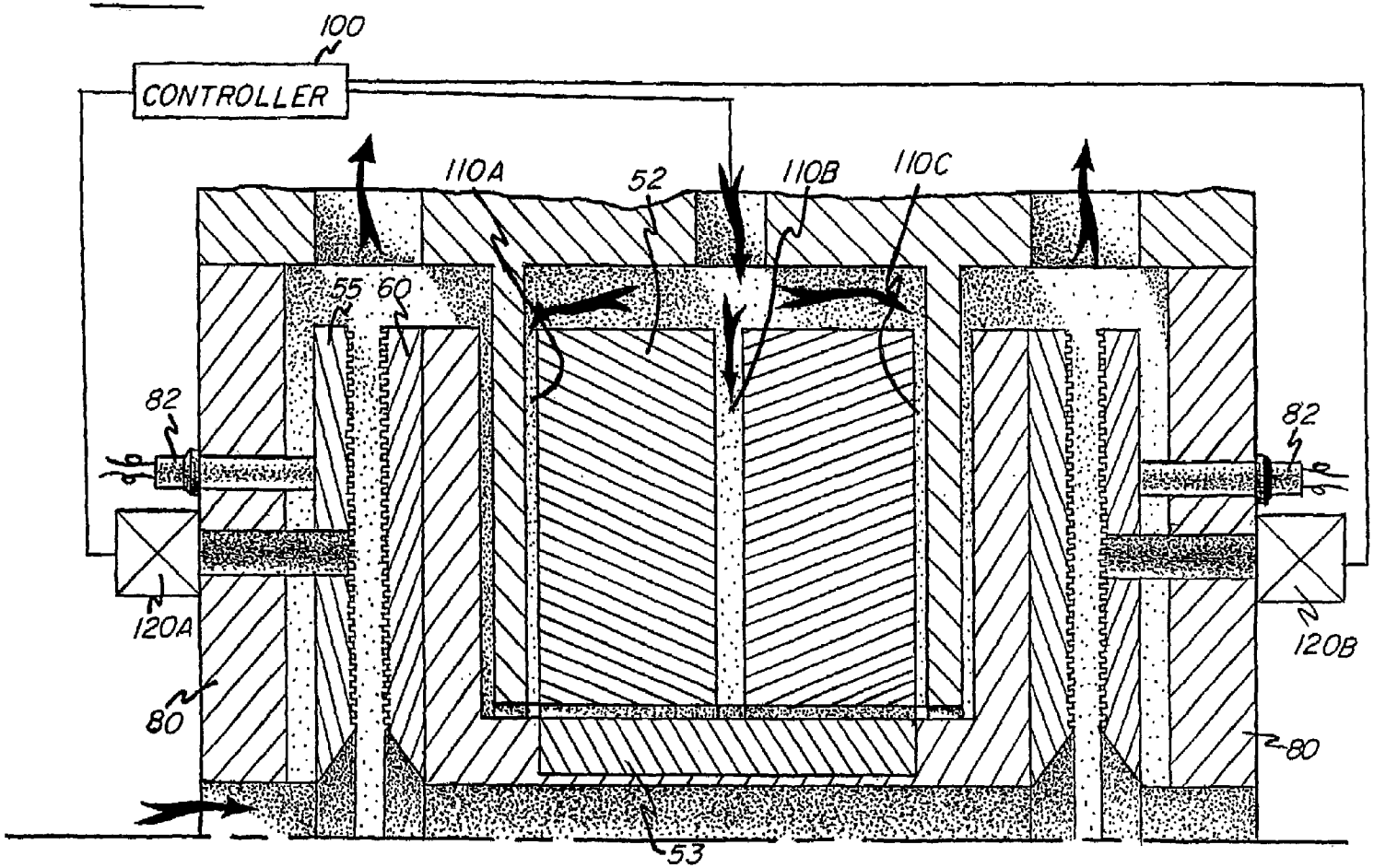
FIG. 4 is a simplified form of the invention using a motor and rotor system as shown in FIG. 3, employing only a hydrostatic radial bearing and in which axial control is supplied either by electrically controlled micro-adjusters associated with the stator plates or by hydrostatic bearings or both.

FIG. 4 is similar to FIG. 3, except that it is simplified in that it uses a single radial bearing control loop from the controller 100 in which the hydrostatic control liquid is applied through the stator through interaxially spaced passages 110A, 110B and 110C into axially spaced positions along the interface between the stator 52 and the rotor 53. A controller could similarly define the axial position with hydrostatic inlets 120A and 120B leading through the respective end walls and the stator plates 60 into the narrow refining gap defined between the plates, as previously described. This may be in addition to the micro-adjuster 82.

It will be appreciated that in all of the embodiments of this invention, the hydrostatic control flows into and through the control relative or related control space into the process fluid and is non-contaminating with respect to such fluid. In the case of a paper pulp refiner, the control fluid may be white water, a suspension of paper pulp, or pure water or other non-contaminating fluid material.

While the forms of apparatus herein described and the methods employed constitute preferred embodiments of this invention, it is to be understood that the invention is not limited to this precise form of apparatus and methods, and that changes may be made therein without departing from the scope of the invention which is defined in the appended claims.

What is claimed is:

1. Method of operating a rotary paper pulp refiner to refine a paper pulp suspension, said method comprising providing a housing including a stator positioned therein and having a stationary refiner plate and a rotor in such housing that has at least one refining plate mounted for rotary co-action relative to the stationary refiner plate with said pulp suspension flowing therebetween, providing a hydrostatic control space between a non-rotating surface of said stator and an immediate adjacent rotating surface of said rotor, supporting such rotor for rotation in said housing and positioning such rotor either axially or radially with respect to said stationary refiner plate by applying hydrostatic fluid pressure to said hydrostatic control space, said hydrostatic fluid being non-contaminating to said paper pulp suspension, controlling the pressure and volume of such hydrostatic fluid in said hydrostatic control space for supporting the rotor in rotational relation to the stator, and providing a passageway for flow of said hydrostatic fluid into said paper pulp suspension.

2. The method of claim 1 wherein said hydrostatic control space is formed between rotating refining plates and non-rotating refining plates.

3. The method of claim 1 in which the hydrostatic control fluid is primarily white water.

4. The method of claim 1 in which said rotor is positioned by hydrostatic bearings both radially and axially with respect to said stator.

5. A rotary paper pulp refiner system including a housing, an inlet in the housing for receiving a suspension of paper pulp to be refined, and a discharge outlet, a rotor in said housing carrying at least said one refiner element, a stator in the housing containing a complementary refining element and defining with the rotor refining element a refining gap through which such suspension is refined while moving from the inlet to the outlet, the improvement comprising a hydrostatic bearing surface formed between said stator and said rotor and opening into said refining gap through which a hydrostatic fluid under pressure is supplied into said gap for coactions with such bearing surface to define the running position of the rotor element with respect to the stator element, said hydrostatic fluid being non-contaminating to said paper pulp suspension, said system further comprising a passageway for flow of said hydrostatic fluid into said suspension of paper pulp.

6. The apparatus of claim 5 further including motor frame housing, a stator of a switched reluctance motor and in which said rotor forms the motor rotor within said stator, the further improvement comprising adjacent axially extending surfaces of said rotor and stator forming a running clearance, said passageway comprising a passage through said stator for admitting said hydrostatic fluid into said running clearance forming a hydrostatic bearing for controlling the radial position of said rotor with respect to said stator.

7. A rotary paper pulp refiner system including a housing, an inlet in the housing for receiving a suspension of paper pulp to be refined, and a discharge outlet, a rotor in said housing carrying at least one said refiner element, a stator in the housing containing a complementary refining element and defining with the rotor refining element a refining gap through which such suspension is refined while moving from the inlet to the outlet, the improvement comprising a hydrostatic bearing surface formed between said stator and said rotor and opening into said refining gap through which a non-contaminating hydrostatic fluid under pressure is supplied into said gap for coactions with such bearing surface and defining the running position of the rotor element with respect to the stator element, a motor frame housing, a stator of a switched reluctance motor and in which said rotor forms the motor rotor within said stator, the further improvement comprising adjacent axially extending surfaces of said rotor and stator forming a running clearance, and a passage through said stator for admitting said hydrostatic fluid into said running clearance forming a hydrostatic bearing for controlling the radial position of said rotor with respect to said stator.

* * * * *